United States Patent [19]

Kasahara et al.

[11] 4,403,771

[45] Sep. 13, 1983

[54] COPYING APPARATUS WITH SLIDABLY ATTACHED SORTER BIN

[75] Inventors: Junkichi Kasahara; Mitsuyoshi Nagashita; Hiroyuki Honda, all of Hachioji, Japan

[73] Assignee: Konishiroku Photo Industry Co., Ltd., Tokyo, Japan

[21] Appl. No.: 258,798

[22] Filed: Apr. 29, 1981

[30] Foreign Application Priority Data

Apr. 30, 1980 [JP] Japan ..... 55-58205

[51] Int. Cl.[3] ..... B65H 39/11

[52] U.S. Cl. ..... 271/294; 187/25

[58] Field of Search ..... 271/294, 293, 292, 287, 271/279, 217; 187/24, 25

[56] References Cited

U.S. PATENT DOCUMENTS 387,111 7/1888 Sedgwick ..... 187/24 UX 3,620,565 11/1971 Eggert et al. ..... 187/24 X 3,995,748 12/1976 Looney ..... 271/294 X 4,148,475 4/1979 Schulz ..... 271/294

4,162,787 7/1979 Shirahase et al. ..... 271/293

*Primary Examiner*—Bruce H. Stoner, Jr.

*Attorney, Agent, or Firm*—Jordan B. Bierman; Linda Bierman; C. Cornell Remsen, Jr.

[57] ABSTRACT

In a copying apparatus equipped with a sorter having a bin unit slidably mounted on the main frame and driven up and down by a vertically supported feed screw, heavy loading of the bin with multiple copies throws the same off balance resulting in strain on the feed screw unit and producing unwanted vibrations. By connecting the bin to the feed screw through an elastically supported nut and positively slidably guiding the movement of the nut in a vertical guide parallel to the feed screw, unwanted vibrations and strains on the feed screw connection are avoided.

3 Claims, 4 Drawing Figures

COPYING APPARATUS WITH SLIDABLY ATTACHED SORTER BIN

BACKGROUND OF THE INVENTION

The present invention relates to a copying apparatus equipped with a sorter, and particularly to such copying apparapus in which the sorter comprises a bin unit having a number of receiving dividers and is moved upwardly and downwardly relative to the main frame of the copying apparatus.

DESCRIPTION OF THE PRIOR ART

The conventional copying apparatus equipped with a sorter is for example illustrated in FIG. 1. Namely, on the side of the main frame 1 of the copying apparatus, the bin unit 3 having a number of receiving dividers 2 is slidably supported for upward and downward movement by the opposed perpendicular guide rails 4 and 5. At the upper and lower ends on the base part of the bin unit 3 and adjacent guide rail 5, a pair of coupling extensions 6 and 7 are provided and a nut 8 (a ball nut is generally used) is fixed to the coupling extension 6. A perpendicular feedng screw 11 is supported on the main frame 1 of the copying apparatus by the bearings 9, 10. The extension 7 is slidably supported on a guide bar 12 arranged as an extension of the feeding screw 11. Consequently, the bin unit 3 can be moved progressively upwardly and downwardly by the driving motor 14 through means such as the timing belt 13; copying paper ejected from the copying apparatus si collated on the bin unit.

However, on copying apparatus with such a construction, an entire bin unit 3 produces unpleasant vibration or a phenomenon of loud noise is observed when a number of copies are stacked on the receiving dividers 2 and the weight of the bin unit is increased, even though in the early stage of collating, the problem is not so severe. Such vibration is believed to be caused by the fact that the mechanical play between the bin unit 3 and the guide rail 4 is magnified and the nut 8 is tilted owing to the remote distance between the feeding screw 11 and the guide rail 4, and the fact that the feeding screw 11 is subject to high speed rotattion and sudden stops for the purpose of improving the copying efficiency. In particular, when the tilt of nut 8 is considered, the weight moment by the weight W of bin unit 3, owing to the mechanical play between bin unit 3 and guide rails 4 and 5, causes coupling members 6 and 7 to produce component vectors F1, F2, F3 and F4 and especially component vectors F1 and F2 upon nut 8, and thus gives a biased load to feeding screw 11, which causes the difficulty in smooth movement of the nut 8. Further, the frequent high speed rotation and stopping thereof for feeding screw 11 create an impactive movement and stop thereof for bin unit 3, which causes noise and vibration.

DETAILED DESCRIPTION OF THE PREFERRED EMBODIMENT

The present invention proposes a copying apparatus equipped with sorter free of noise and vibration as mentioned above.

The details of the present invention will be described as follows with the aid of FIGS. 2, 3 and 4.

Figure 1:
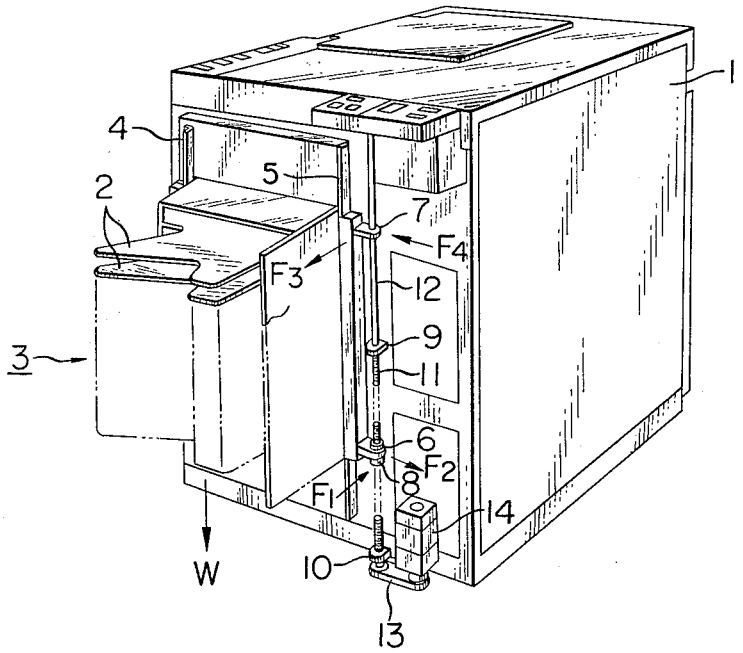
FIG. 1 PRIOR ART
FIG. 1 is an illustrative view of the conventional copying apparatus having a sorter.
Figure 3:
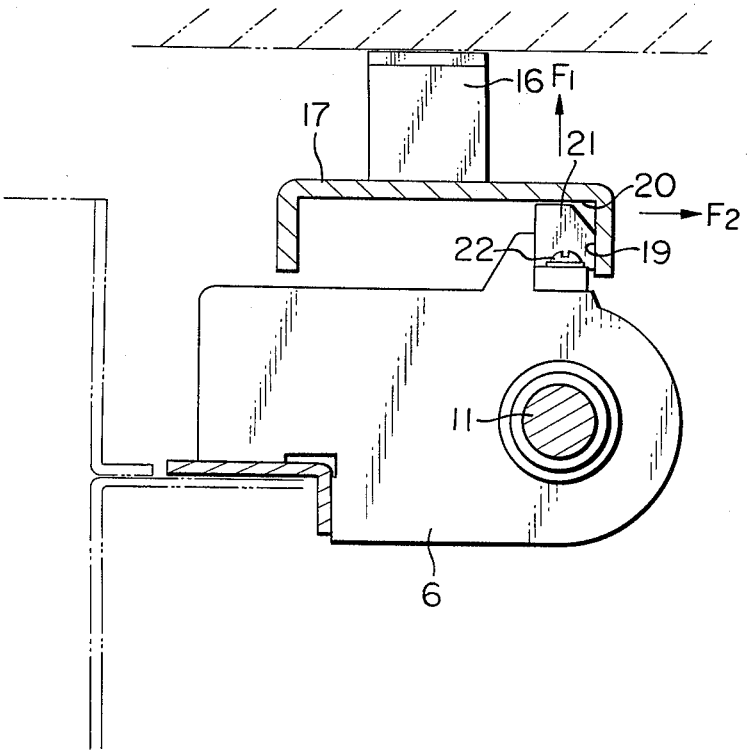
FIG. 3 is an enlarged sectional view of the said main portion.
Figure 2:
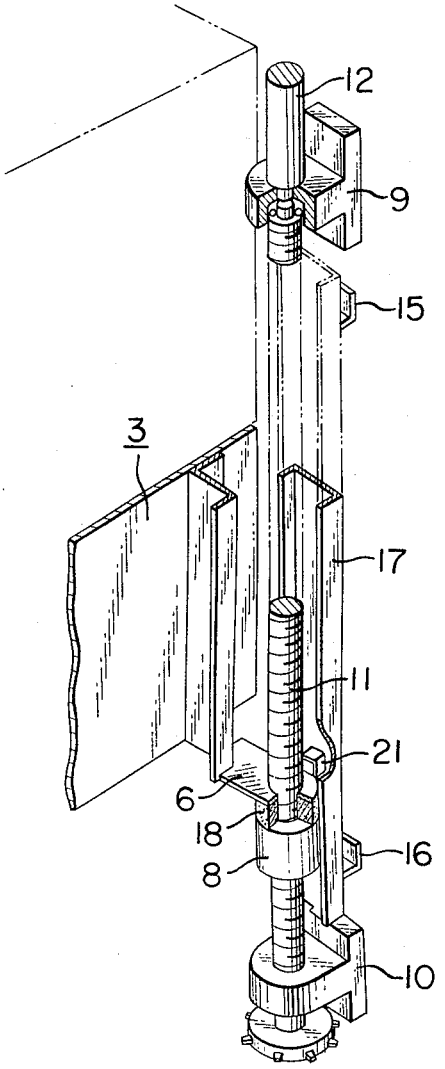
FIG. 2 is a perspective view of the main portion of the copying apparatus according to the present invention.

FIG. 2 and FIG. 3 represent the first example of the present invention and for the same structural portions thereof as FIG. 1, the same symbols as in FIG. 1 are used. The point of the present invention lies in the fact that a guide member 17 fixed to the main frame of the copying apparatus by stays 15 and 16 is used, and that elastic member (a shock absorbing member) 18 such as a cushion rubber is interposed between coupling extension 6 and nut 8. Guide member 17 is positioned closely to and in parallel with feeding screw 11 and is formed with a first guide face 19 facing bin unit 3 and a second guide face 20 that is at right angles to the first guide face 19 and faces nut 8. At the rear side of coupling extension 6 close to guide faces 19 and 20, a sliding member 21 that is slidable along guide faces 19 and 20 is attached to said extension 6 by screw 22. The elastic member 18 in the case illustrated, is firmly glued with adhesives to nut 8 and coupling extension 6, which prevents its rotation.

Figure 4:
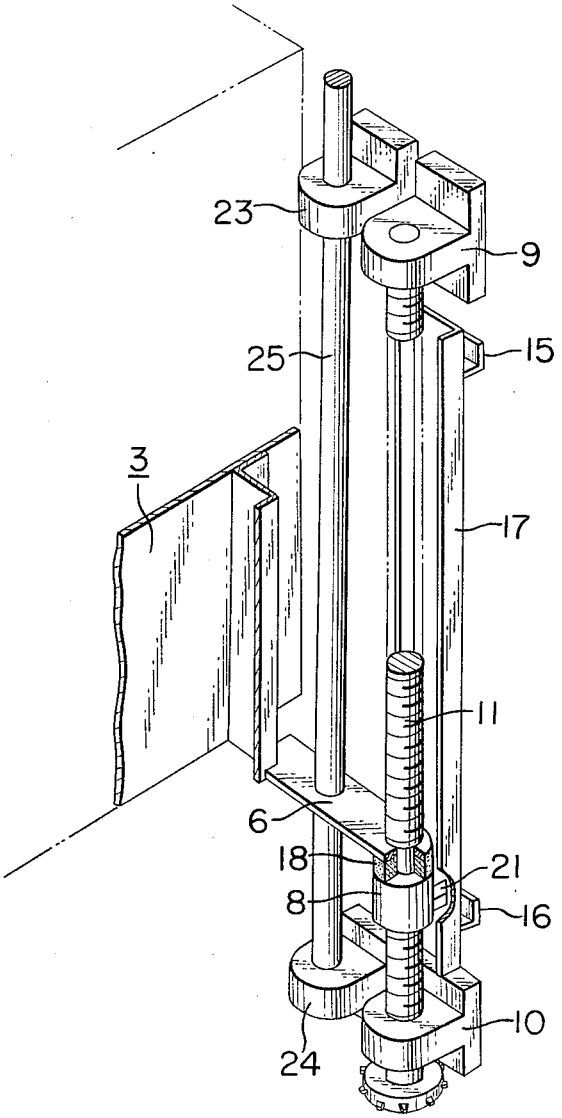
FIG. 4 is a perspective view of a second example of the present invention.

FIG. 4 represents a second example of the present invention and in this example, guide bar 25 arranged on the main frame of the copying apparatus by stays 23 and 24 so as to be parallel with feeding screw 11 is used and the aforesaid sliding member 21 is attached to the outer surface of nut 8. In this case rotation of nut 8 is prevented by the interaction of sliding member 21 and guide member 21 and guide member 17, and therefore elastic member 18 need not necessarily be fixed to nut 8 and to coupling extension 6.

In the aforesaid examples, when coupling member 6 tends to tilt owing to the mechanical play between the bin unit 3 and the guide rail 4, the biased load is not applied to nut 8 and the movement of nut 8 is not affected since the fact that component vectors F1 and F2 are absorbed by guide faces 20 and 19 of guide member 17 and thus there is no effect of component vectors F1 and F2 upon nut 8 as in FIG. 2 and FIG. 3, and this inclination is prevented by guide bar 25 for FIG. 4. Furthermore, elastic member 18 cushions the movement of quick starts and quick stops of nut 8 caused by the rotation of feeding screw 11, and transfers them to the bin unit 3 and therefore the probability that the bin unit 3 is moved impulsively is decreased even if feeding screw 11 is rotated at high speed. In the example of FIG. 2 and FIG. 3, it is possible to attach sliding member 21 to nut 8. In this case, it is possible to obtain the same effect as in the other examples due to the fact that elastic member 18 is transformed so as to cushion the biased load, and the movement of nut 8 is accurately regulated by the contact between sliding member 21 and guide member 17, even when coupling member 6 is tilted by the biased load of the bin unit.

While our invention has been described with reference to specific embodiments thereof, variations falling within the skill of the artisans in this field are contemplated, and the invention is not to be limited to the specific examples given but only as may be required by the claims which follow.

What is claimed is:

1. In a copying apparatus equipped with a sorter consisting of a bin supported for sliding up and down movement relative to a main frame, a feeding screw vertically supported on the main frame, a nut on said feeding screw, a first coupling extension attached at one end to said bin and at its other end slidably mounted on said feeding screw, a second coupling extension attached at one end to said bin and it its other end to said nut, and means for rotating said feeding screw to cause movement of said nut and up and down movement of said bin attached thereto, the improvement comprising a U-shaped guide rail vertically mounted on said main frame parallel to said feeding screw with the arms of said U extending toward said feeding screw and said second coupling extension, guide means intermediate said second coupling extension and said guide rail, said guide means having two faces projecting toward said U-shaped guide rail with one face slidably contacting the main inner vertical face of said U-shaped guide rail and the other face slidably contacting the inner face of one of the arms of said U-shaped guide rail, and an elastic shock-absorbing means intermediate said nut and said second coupling extension, whereby imbalance of the bin caused by the weight of stacked copies and vibrations caused by movement of said feeding screw are avoided by the cushioning effect of said shock-absorbing means and the regulated contact between said second coupling extension and said U-shaped guide rail through said guide means.

2. In a copying apparatus according to claim 1, in which said guide means is fixedly attached to said second coupling extension.

3. In a copying apparatus according to claim 1, in which said guide means is fixedly attached to the outer surface of said nut.

* * * * *